US007136497B2

(12) United States Patent
McSwiggen

(10) Patent No.: US 7,136,497 B2
(45) Date of Patent: Nov. 14, 2006

(54) ACOUSTICAL SWITCH FOR A DIRECTIONAL MICROPHONE

(75) Inventor: John P. McSwiggen, Bloomingdale, IL (US)

(73) Assignee: Knowles Electronics, LLC., Itasca, IL (US)

( * ) Notice: Subject to any disclaimer, the term of this patent is extended or adjusted under 35 U.S.C. 154(b) by 752 days.

(21) Appl. No.: 10/417,577

(22) Filed: Apr. 17, 2003

(65) Prior Publication Data

US 2004/0028252 A1 Feb. 12, 2004

Related U.S. Application Data

(60) Provisional application No. 60/373,119, filed on Apr. 17, 2002.

(51) Int. Cl.
*H04R 25/00* (2006.01)

(52) U.S. Cl. ..... 381/313; 381/322; 381/329

(58) Field of Classification Search ..... 381/312, 381/313, 322, 324, 329, 355, 356, 357, 359, 381/360

See application file for complete search history.

(56) References Cited

U.S. PATENT DOCUMENTS 3,835,263 A 9/1974 Killion
3,836,732 A * 9/1974 Johanson et al. ..... 381/313
3,975,599 A 8/1976 Johanson
4,142,072 A 2/1979 Berland
5,259,035 A 11/1993 Peters et al.
5,524,056 A 6/1996 Killion et al.
5,692,060 A 11/1997 Wickstrom
5,757,933 A 5/1998 Prevers et al.
5,835,608 A 11/1998 Warnaka et al.
5,990,425 A 11/1999 McSwiggen
6,075,869 A 6/2000 Killion et al.
6,134,334 A 10/2000 Killion et al.

(Continued)

FOREIGN PATENT DOCUMENTS

DE 23 46 531 4/1975

(Continued)

*Primary Examiner*—Sinh Tran
*Assistant Examiner*—Brian Ensey
(74) *Attorney, Agent, or Firm*—Marshall, Gerstein & Borun LLP

(57) ABSTRACT

An acoustical switch is provided for a directional microphone of a hearing aid device. The hearing aid device includes a faceplate having a switch aperture, a front port, and a rear port. The microphone includes a front inlet in communication with the front port within the face plate and a front chamber of the microphone. The microphone further includes two rear inlets in communication with the rear port within the faceplate and a rear chamber of the microphone. The acoustical switch comprises a switch actuator having a body portion and a lever portion. The body portion includes a first closure surface and a second closure surface. The switch actuator is adapted to be disposed within the switch aperture of the face plate of the hearing aid device such that the body portion is disposed adjacent to the inlets of the microphone. The switch actuator s moveable between a first position wherein the first closure surface of the body portion is adapted to cover one of the rear inlets of the microphone, and a second position wherein the second closure surface of the body portion is adapted to cover the other of the rear inlets of the microphone. The body portion includes a side surface having an acoustical resistance associated therewith wherein the acoustical resistance is substantially greater than an acoustical resistance between either of the ports and its respective microphone chamber.

20 Claims, 5 Drawing Sheets

U.S. PATENT DOCUMENTS

| | | | | |
|---|---|---|---|---|
| 6,151,399 | A | 11/2000 | Killion et al. | |
| 6,876,749 | B1 * | 4/2005 | Killion et al. | 381/355 |
| 2002/0001391 | A1 * | 1/2002 | Darbut | 381/322 |

FOREIGN PATENT DOCUMENTS

| | | | |
|---|---|---|---|
| EP | 0 984 666 | A2 | 3/2000 |
| EP | 0 984 666 | A3 | 9/2001 |
| WO | WO-01/69964 | A2 | 9/2001 |
| WO | WO-01/69967 | A2 | 9/2001 |

* cited by examiner

ACOUSTICAL SWITCH FOR A DIRECTIONAL MICROPHONE

RELATED APPLICATION

This application claims priority to U.S. Provisional Application Ser. No. 60/373,119, filed Apr. 17, 2002.

TECHNICAL FIELD

The present invention generally relates to mechanical switches for microelectronic devices, and more particularly to an acoustical switch for a directional microphone in a hearing aid.

BACKGROUND OF THE INVENTION

Present hearing aid microphones are typically limited to being optimized for directional sensitivity or omnidirectional sensitivity to sounds that impinge upon the diaphragm of the microphone. The directivity of a microphone is the sensitivity of a microphone to a sound component at different angles of incidence. The microphone is typically optimized to be more sensitive to one component of the sound over the other. However, undesirable noise may occur within the hearing aid when a microphone that is optimized for a given directional component of an impinging sound receives higher levels of sound having other directional components.

Typical hearing aids either include a non-directional or directional hearing aid microphone system. An omnidirectional hearing aid system allows the user to pickup sounds from any direction. When a hearing aid user is trying to carry on a conversation within a crowded room, an omnidirectional hearing aid system does not allow the user to easily differentiate between the voice of the person the user is talking to and background or crowd noise. A directional hearing aid helps the user to hear the voice of the person they are having a conversation with, while reducing the miscellaneous crowd noise present within the room.

A hearing aid that provides selectivity between a directional and an omnidirectional mode will experience a change in sensitivity that is readily apparent when switching between modes. This change in sensitivity can be very uncomfortable to the hearing aid user.

Controllable directivity and sensitivity can help a wearer of a hearing aid to better understand a person speaking directly at the wearer while reducing the level of undesirable noise. Thus, there is a need for a hearing aid device having a microphone that can be acoustically optimized for both directional and omnidirectional sensitivity, depending upon the circumstances presented to the wearer of the hearing aid.

SUMMARY OF THE INVENTION

An acoustical switch is provided for a directional microphone of a hearing aid device. The hearing aid device includes a faceplate having a switch aperture, a front port, and a rear port. The microphone includes a front inlet in communication with the front port within the face plate and a front chamber of the microphone. The microphone further includes two rear inlets in communication with the rear port within the faceplate and a rear chamber of the microphone. The acoustical switch comprises a switch actuator having a body portion and a lever portion. The body portion includes a first closure surface and a second closure surface. The switch actuator is adapted to be disposed within the switch aperture of the face plate of the hearing aid device such that the body portion is disposed adjacent to the inlets of the microphone. The switch actuator s moveable between a first position wherein the first closure surface of the body portion is adapted to cover one of the rear inlets of the microphone, and a second position wherein the second closure surface of the body portion is adapted to cover the other of the rear inlets of the microphone. The body portion includes a side surface having an acoustical resistance associated therewith wherein the acoustical resistance is substantially greater than an acoustical resistance between either of the ports and its respective microphone chamber.

According to another aspect, the switch further includes at least three electrical contacts each having a portion juxtaposed to the side surface of the body portion of the switch actuator, wherein the side surface includes a swiping contact disposed therein and adapted to make selective contact with the portions of the electrical contacts when the switch actuator is moved from the first position to the second position.

According to another aspect, the switch further includes a switch housing having the switch actuator moveably disposed therein, wherein the switch housing adapted to engage the microphone.

These and other aspects will become readily apparent upon reading the Detailed Description in conjunction with the Drawings.

DETAILED DESCRIPTION OF THE PREFERRED EMBODIMENTS

While the present invention will be described fully hereinafter with reference to the accompanying drawings, in which particular embodiments are shown, it is to be understood at the outset that persons skilled in the art may modify the invention herein described while still achieving the desired result of this invention. Accordingly, the description which follows is to be understood as a broad informative disclosure directed to persons skilled in the appropriate arts and not as limitations of the present invention.

Figure 1:
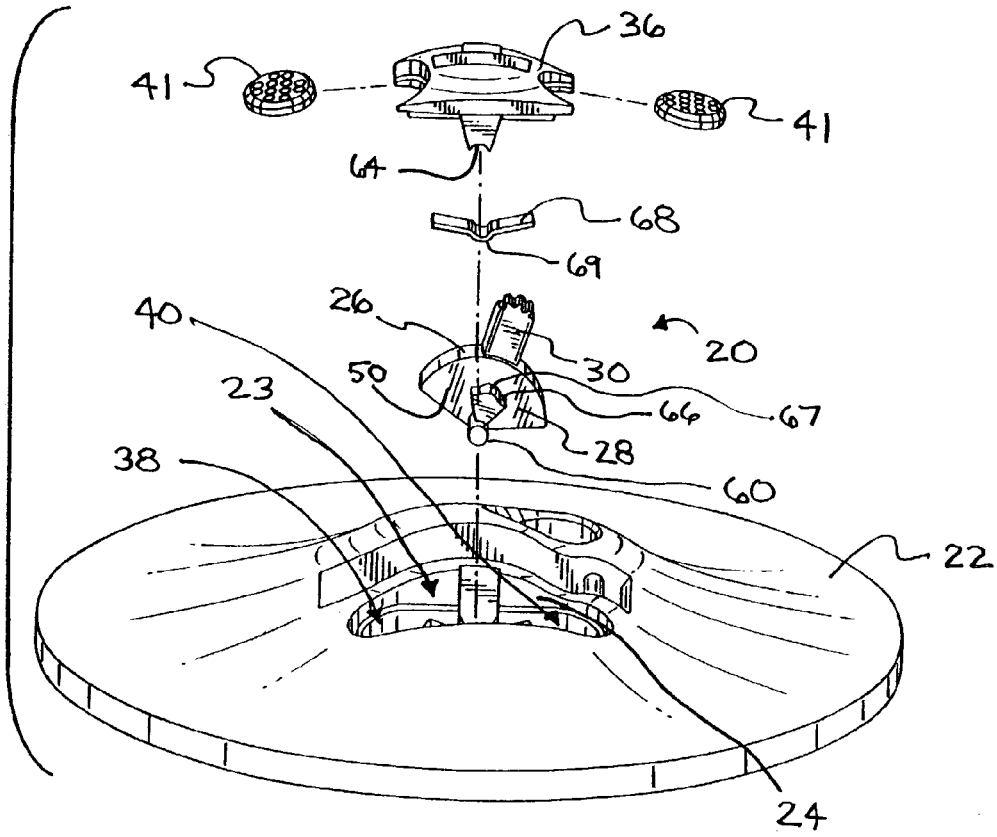
FIG. 1 is an exploded assembly view of a first embodiment of an acoustical switch in accordance with the principles of the present invention and an associated faceplate assembly.
Figure 2:
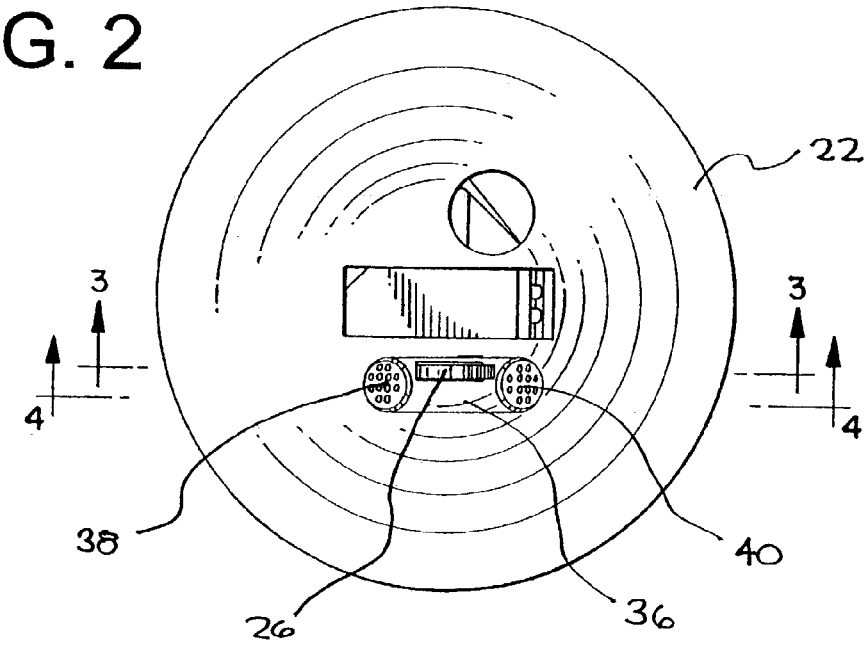
FIG. 2 is a top plan view of the acoustical switch and faceplate assembly of FIG. 1.
Figure 3:
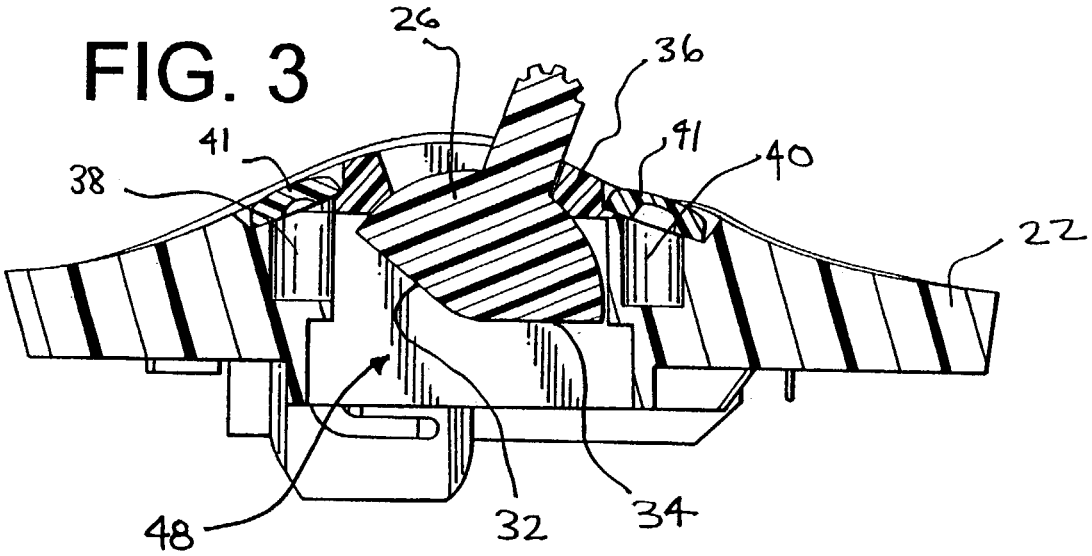
FIG. 3 is a cross-sectional view of the acoustical switch and faceplate assembly taken along section line 3—3 in FIG. 2.

An embodiment in accordance with the present invention is shown in FIGS. 1–5 as an acoustical switch 20 for use within a faceplate 22 of a hearing aid device (not shown). The faceplate includes a switch aperture 23 that defines a side surface 24 of the aperture 23. The switch 20 includes a switch actuator 26 having a body portion 28 and a lever portion 30. The body portion 28 includes a first closure surface 32 and a second closure surface 34, as shown in FIG. 3. As best shown in FIGS. 1 and 2, a switch body cover 36, as part of the faceplate 22 in this particular embodiment, is provided to fit into the switch aperture 23 of the faceplate 22 and cover the switch actuator 26. The faceplate 22 and portions of the switch body cover 36 form a front port 38 and a rear port 40. Each of the ports may be covered with a screen 41. The front port 38 is in communication with a front inlet 42 and the rear port 40 is in communication with a rear inlet 44 of a microphone 45 (shown in FIG. 5). Additionally, the front port 38 is in communication with a smaller additional rear inlet 46 of the microphone 45. The front inlet 42 is in communication with a front chamber (not shown) of the microphone 45 and the rear inlets 44, 46 are in communication with a rear chamber (not shown) of the microphone 45.

When the switch 20 is installed within a hearing aid device, the microphone 45 is positioned adjacent to the switch actuator 26 and partially disposed within an opening or space 48 (as best shown in FIG. 3) such that the switch actuator 26 is moveably operable to selectively cover either of the rear inlets 44 and 46 of the microphone. In either selected position of the switch actuator 26, the front inlet 42 always remains uncovered.

To switch the microphone into a first position corresponding to a DIRECTIONAL mode, the switch actuator 26 is moved or toggled such that the first closure surface 32 covers the smaller additional rear inlet 46 but does not cover the rear inlet 44. With the front inlet 42 and the rear inlet 44 open, the microphone operates as a conventional directional microphone. To switch the microphone into a second position corresponding to an OMNIDIRECTIONAL mode, the switch actuator 26 is moved or toggled such that the second closure surface 34 covers the rear inlet 44 and opens the smaller additional rear inlet 46. In this mode, a substantial amount of sound pressure is prevented from reaching the rear chamber, except for a small amount of sound pressure provided to the rear chamber of the microphone via additional rear inlet 46 from the front port 34. This additional sound pressure, or "leaker pressure," compensates for a rise in microphone sensitivity at low frequencies when the switch actuator 26 is toggled into the OMNIDIRECTIONAL mode.

A problem associated with acoustical switches is their capacity to deal with acoustical leakage signals that may effectively increase or decrease the effective signals that impinge on the inlets of the microphone. One way to deal with leakage around the switch actuator 26 is to increase the acoustical resistance. One way this can be done is by tightening the tolerances between the switch actuator 24 and its surrounding components—in this embodiment, the faceplate 22, which may include portions of the switch body cover 36. From a design and manufacturability standpoint, however, this is very difficult. Rather than focus on tighter tolerances to decrease leakage, the present invention focuses on increasing the acoustical path, which is another way to increase the acoustical resistance. A particular feature of the switch actuator 26 that is beneficial to this concept are a pair of side surfaces 50 (only one shown in FIG. 1), which, together with the juxtaposed side surface 24 of the aperture 23, provide a longer acoustical path to leakage signals and therefore higher acoustical resistance to the signals. In a preferred embodiment, the switch actuator 26 has a geometric "pie shape," or "circle sector" configuration, as shown in FIG. 1. This configuration defines the large side surfaces 50, which each have a surface area larger than a surface area of each of the closure surfaces 32 and 34, individually. This increased surface area lengthens the acoustical path for any leakage signal between either one of the side surfaces 50 and the side surface 24 of the aperture 23. Thus, the acoustical resistance of this path is substantially greater than an acoustical resistance between either of the ports 38, 40 and its respective microphone chamber.

Figure 4:
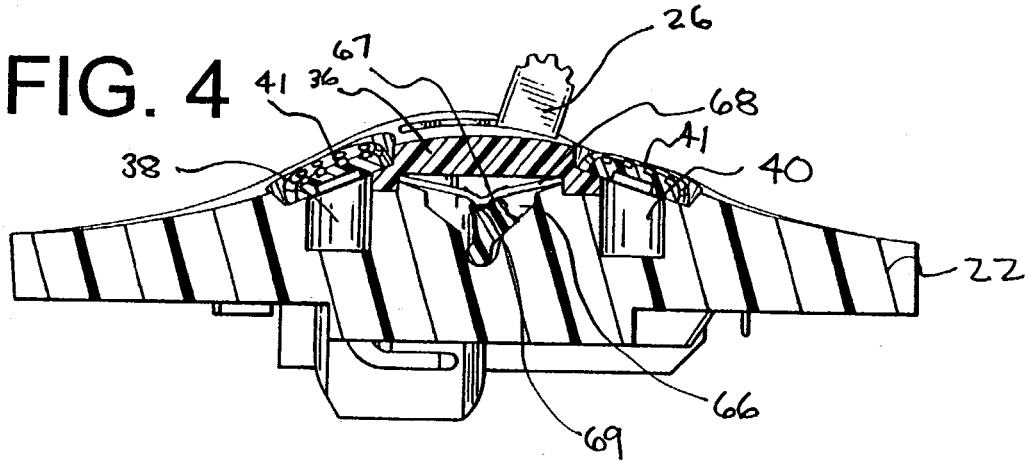
FIG. 4 is a cross-sectional view of the acoustical switch and faceplate assembly taken along section line 4—4 in FIG. 2.

In a preferred embodiment, the switch actuator 26 includes a pair of pivot pins 60 (only one shown in FIG. 1) that extends from both side surfaces 50. Each pivot pin 60 bears against a bearing surface (not shown) within the faceplate 22 and is held in place by a mating bearing surface 64 on the switch body cover 36, as shown in FIG. 1. The pivot pins 60 allow the switch actuator 26 to be toggled between the switch positions. The switch actuator 30 includes a detent surface 66 having a detent bump 67 that correspondingly mates with a detent spring 68 having a detent bump 69 to provide a detented position for the DIRECTIONAL and OMNIDIRECTIONAL switch positions. The cross-sectional view of FIG. 4 shows the detent surface 66 mating with the detent spring 68. As the switch actuator 26 is toggled to either position, the detent bump 67 of the detent surface 66 causes the detent spring 68 to deflect until the detent bump 67 passes the detent bump 69 on the detent spring 68, which causes the spring 68 to return to its pre-deflected state. Thus, the switch actuator 26 is maintained in either toggled position until enough force is applied by a user to overcome the spring force applied by the detent spring 68.

Figure 5:
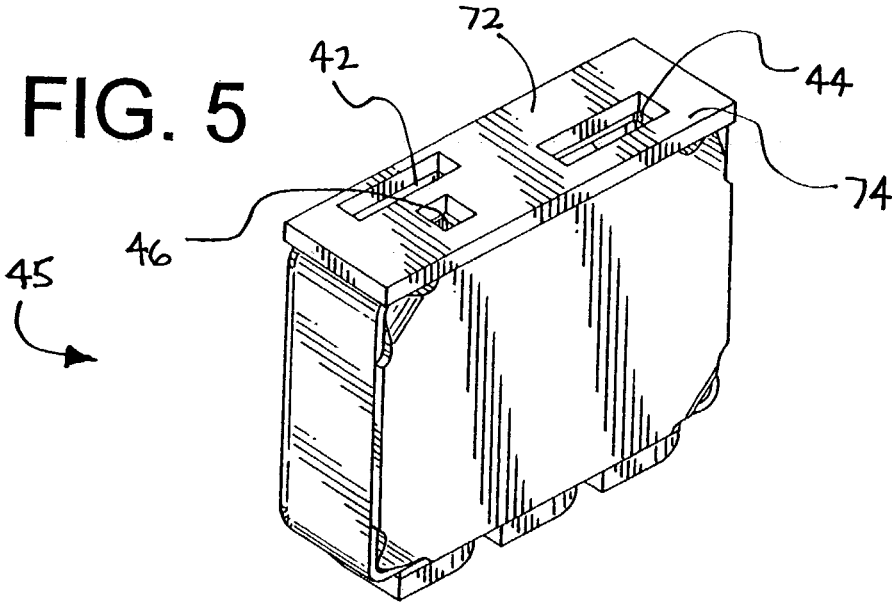
FIG. 5 is a perspective view of a microphone and gasket assembly for use with the acoustical switch of the present invention.

In either toggled position, one of the two closure surfaces 32, 34 bear against an inlet surface 72 of the microphone 45 to close one of the inlets 42, 44, and 46. As shown in FIG. 5, a gasket 74 may be disposed on the inlet surface 72 of the microphone 45 to promote a sealing engagement with the closure surfaces 32, 34 of the switch actuator 26.

Figure 6:
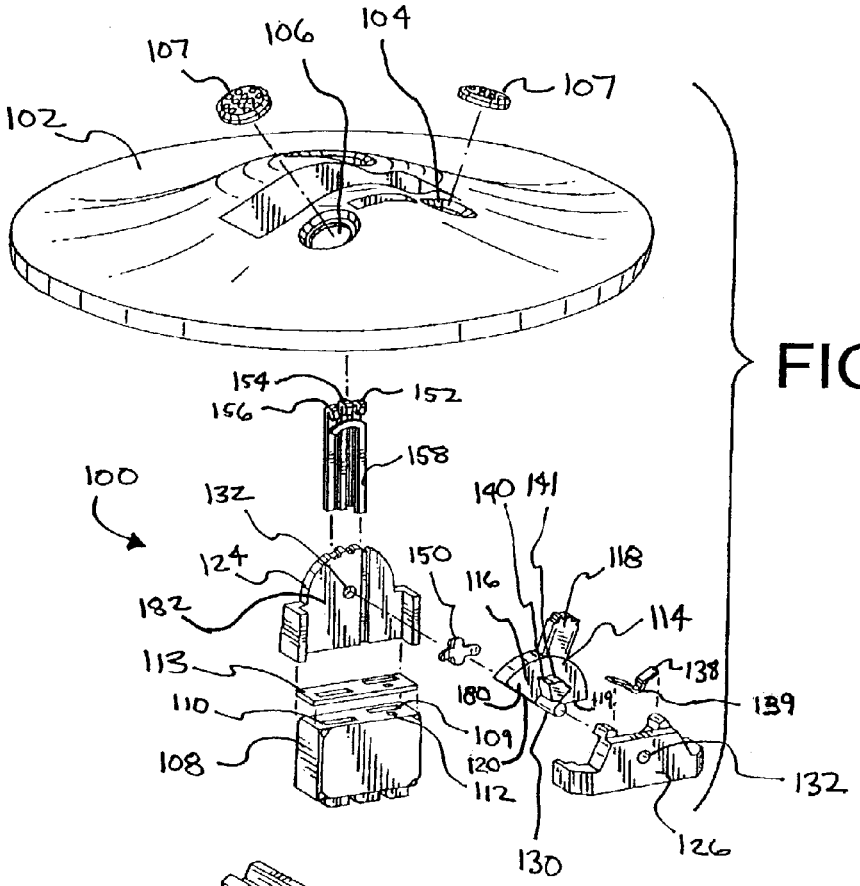
FIG. 6 is an exploded assembly view of a second embodiment of an acoustical switch in accordance with the principles of the present invention and associated faceplate assembly.

FIG. 6 shows an alternate embodiment switch 100, which is an acoustical switch incorporating an electrical switching arrangement. It should be noted, however, that this embodiment could also be implemented solely as an acoustical switch. Likewise, it is to be understood that the previously described embodiment shown in FIGS. 1–4 could also be implemented with an electrical switching arrangement.

Figure 7:
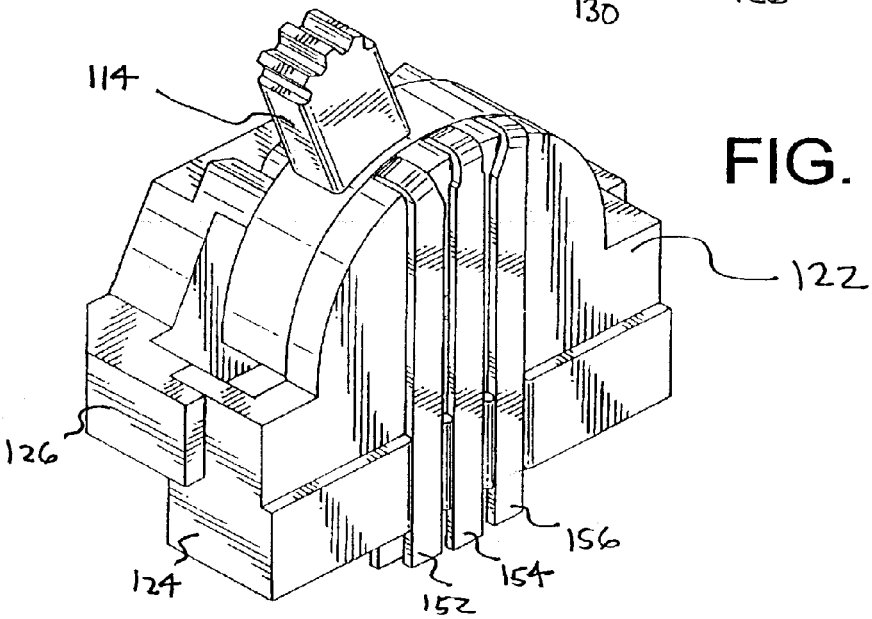
FIG. 7 is a perspective view of the acoustical switch of FIG. 6.

The switch assembly 100 can be installed within a faceplate 102 as shown in FIG. 6. The faceplate 102 includes a front port 104 and a rear port 106 each having a screen 107. Similar to the previous embodiment, the front port 104 is in communication with a front chamber of a microphone 108 via a front inlet 109. Likewise, the rear port 106 is in communication with a rear chamber of the microphone 108 via a rear inlet 110. A smaller additional rear inlet 112 of the microphone 108 is in communication with the front port 104. The microphone 108 also includes a gasket 113. Unlike the previous embodiment, however, the switch 100 is fully integrated as a separate "drop-in" component or module, as shown in FIG. 7.

Figure 8:
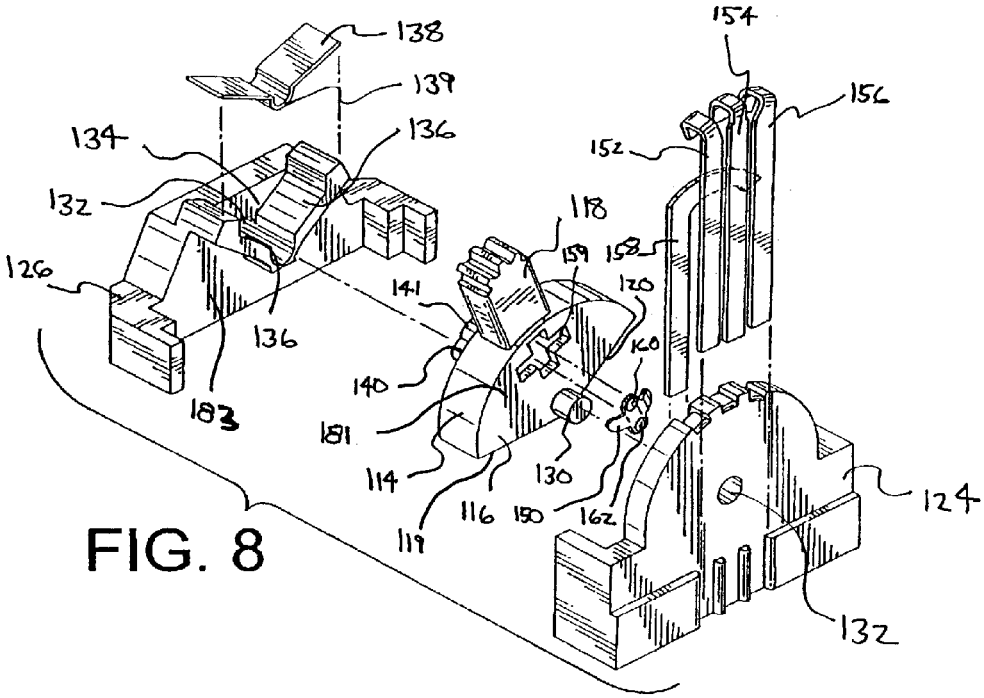
FIG. 8 is an exploded assembly view of the acoustical switch of FIGS. 6–7.

Referring to an exploded view of the switch 100 in FIG. 6 or FIG. 8, the switch 100 includes a switch actuator 114 having a body portion 116 and a lever portion 118. The body portion 116 includes a first closure surface 119 and a second closure surface 120. As shown in FIG. 7, the switch actuator 114 is disposed within a switch housing 122. Referring again to FIG. 6 or FIG. 8, the switch housing 122 comprises a first housing portion 124 and a second housing portion 126 that enclose the body portion 116 of the switch actuator 114 when connected together. The housing portions 124, 126 can be connected by means of adhesive, sonic welding, other suitable welding techniques, over-molding, snap-fit, mechanical fasteners, or any equivalent. The housing 122 is adapted to engage the microphone 108 such that the switch actuator 114 is disposed adjacent to the inlets 109, 110 and 112 of the microphone 108.

The switch actuator 114 includes a pair of pivot pins 130 (one shown in FIG. 6 and the other shown in FIG. 8). Each of the pivot pins 130 are held in position by one of a pair of pin apertures 132 in the switch housing 122. As best shown in FIG. 6, the second housing portion 126 includes a notch 134 having a pair of sloped surfaces 136 to accommodate a detent spring 138 having a detent bump 139, which is identical to the detent spring 68 and detent bump 69 of the first embodiment. Similarly, the switch actuator 114 also includes a corresponding detent surface 140 and a detent bump 141, which is identical in structure and function as the detent surface 66 and detent bump 67 of the first embodiment shown in FIGS. 1–4. The detent mechanism of this embodiment operates identically to the detent mechanism previously described for the first embodiment. Additionally, the closure function between the switch actuator 114 and the microphone 108 is identical to the first embodiment.

Figure 9:
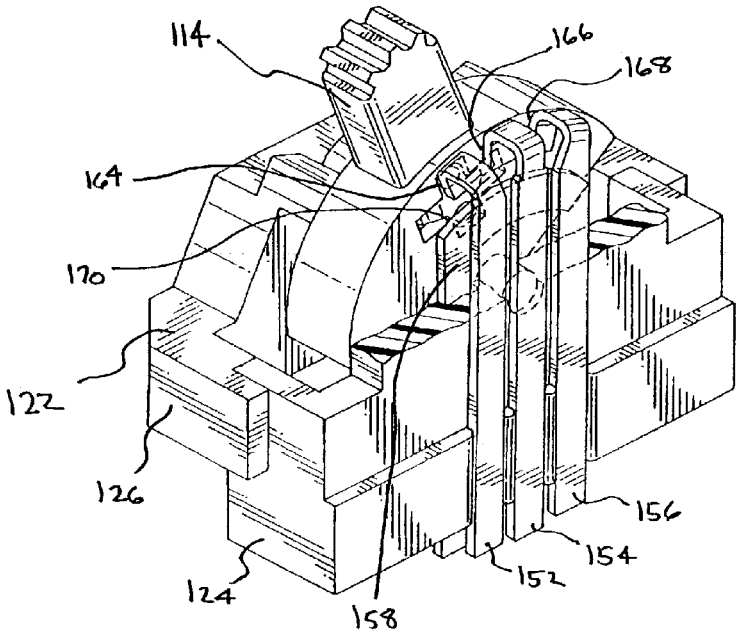
FIG. 9 is a perspective view of the acoustical switch of FIGS. 6–8 having a portion cut away to show an electrical contact arrangement.
Figure 10:
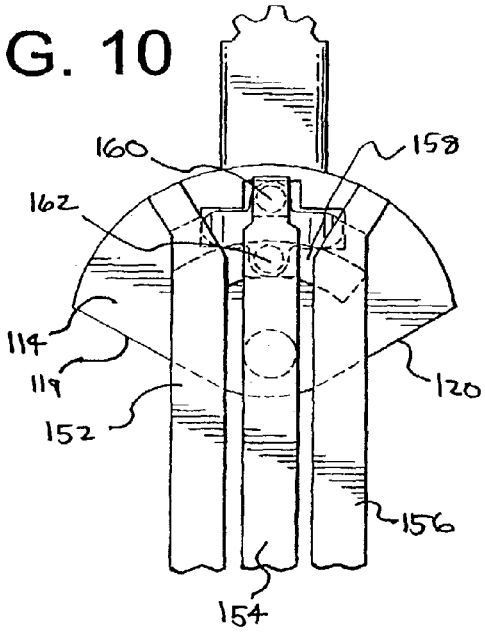
FIG. 10 is a schematic view of a switch actuator and a contact arrangement of the acoustical switch of FIG. 9 illustrating a neutral position of the switch.
Figure 11:
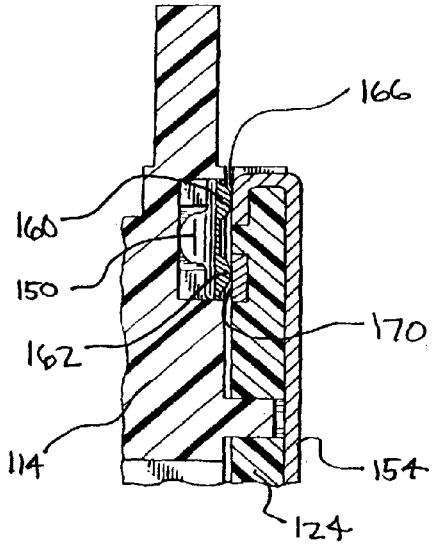
FIG. 11 is a partial cross-sectional view of the switch actuator and contact arrangement shown in FIG. 10.
Figure 12:
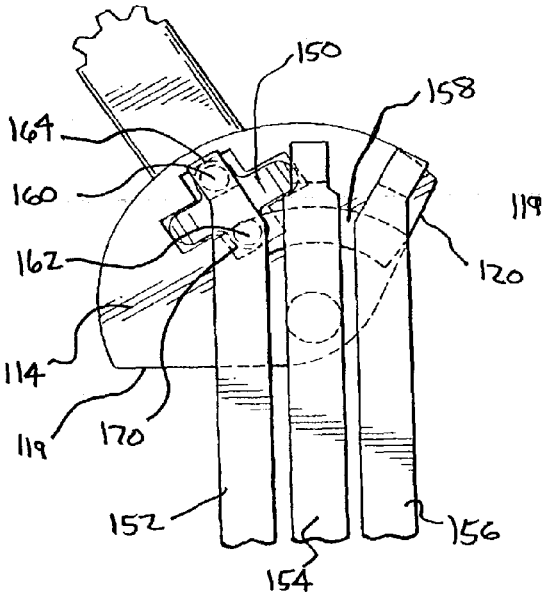
FIG. 12 is a schematic view of a switch actuator and a contact arrangement of the acoustical switch of FIG. 9 illustrating a first position of the switch.
Figure 13:
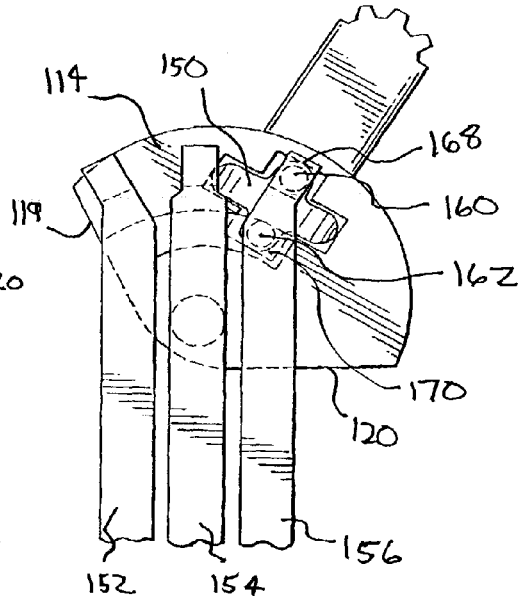
FIG. 13 is a schematic view of a switch actuator and a contact arrangement of the acoustical switch of FIG. 9 illustrating a first position of the switch.

The switch 100 also includes an electrical switch arrangement comprising a swiping contactor 150 and a series of electrical contacts 152, 154, 156 and 158, as best shown in FIG. 8. The swiping contactor 150 is disposed within a pocket, or recess 159 within the switch actuator 114. The swiping contactor 150 includes two raised contact points 160 and 162, which, as shown in FIG. 9, selectively make contact with a series of contact surfaces 164, 166, 168 and 170 on the electrical contacts 152, 154, 156 and 158 when the switch actuator 114 is toggled between various positions. FIG. 10 is a schematic view showing the switch actuator 114 in a neutral or middle position wherein the contact point 160 is in contact with the contact surface 166, and the contact point 162 is in contact with the contact surface 170. FIG. 11 is a cross-sectional view showing the interaction between the contact point 160 and the contact surface 166, as well as the contact point 162 and the contact surface 170. FIGS. 12 and 13 are schematic views showing the switch actuator 114 in a first position and a second position, respectively. In the first position shown in FIG. 12, the contact point 160 makes contact with the contact surface 164 and the contact point 162 maintains contact with the contact surface 170. In the second position shown in FIG. 13, the contact point 160 makes contact with the contact surface 168 and the contact point 162 again maintains contact with the contact surface 170.

Depending on the position of the switch actuator 114, including a DIRECTIONAL and OMNIDIRECTIONAL switch position, the electrical switch arrangement facilitates selective connection to electronic circuitry (not shown), which provides electronic adjustment of sensitivity for the selected mode. In the first position shown in FIG. 12, the switch is in a DIRECTIONAL position, wherein the additional rear inlet of the microphone is covered and bridging of the electrical contacts 152 and 158 provide electronic adjustment of sensitivity for the DIRECTIONAL mode of operation. In the second position in FIG. 13, the switch is in an OMNIDIRECTIONAL position, wherein the rear inlet is covered and bridging of the electrical contacts 156 and 158 provide electronic adjustment of sensitivity for the OMNIDIRECTIONAL mode of operation.

Similar to the first embodiment, this embodiment also incorporates the increased acoustical path concept for increasing acoustical resistance to acoustical leakage signals. Referring to FIGS. 6 and 8, this is accomplished by providing a pair of side surfaces 180, 181 of the switch actuator 114, which, together with a respective juxtaposed interior surface 182, 183 of the switch housing 122, provide a longer acoustical path to leakage signals and therefore higher acoustical resistance to the signals. In a preferred embodiment, the switch actuator 114 has a geometric "pie shape," or "circle sector" configuration, as shown in FIG. 8. This configuration defines the large side surfaces 180, 181, which each have a surface area larger than a surface area of each of the closure surfaces 119 and 120, individually. This increased surface area lengthens the acoustical path for any leakage signal between one of the interior surfaces 180, 181 and the respective mating side surface 182, 183 of the housing 122. Thus, the acoustical resistance of this path is substantially greater than an acoustical resistance between either of the ports 104, 106 and its respective microphone chamber.

As shown in FIGS. 6 and 8, each of the contact surfaces 164, 166, 168 and 170 on the electrical contacts 152, 154, 156 and 158 are juxtaposed to the adjacent side surface 181 of the switch actuator 114. In a preferred embodiment, the electrical contacts 152, 154, 156 and 158 are insert molded with the housing 122. Additionally, the swiping contactor 150 can be insert molded into the switch actuator 114, as long as the swiping contactor 150 is allowed to deflect and maintain its spring-like quality to ensure that it can be pre-loaded to maintain contact against the contact surfaces 164, 166, 168 and 170.

While the specific embodiments have been illustrated and described, numerous modifications may come to mind without significantly departing from the spirit of the invention and such insignificant modifications are considered within the scope of the invention.

What is claimed is:

1. An acoustical switch for a directional microphone of a hearing aid device, the hearing aid device including a faceplate having a switch aperture, a front port, and a rear port, the microphone including a front inlet in communication with the front port within the face plate and a front chamber of the microphone, and two rear inlets in communication with the rear port within the faceplate and a rear chamber of the microphone, the acoustical switch comprising a switch actuator having a body portion and a lever portion, the body portion including a first closure surface and a second closure surface, the switch actuator adapted to be disposed within the switch aperture of the face plate of the hearing aid device such that the body portion is disposed adjacent to the inlets of the microphone, the switch actuator moveable between a first position wherein the first closure surface of the body portion is adapted to cover one of the rear inlets of the microphone, and a second position wherein the second closure surface of the body portion is adapted to cover the other of the rear inlets of the microphone, the body portion including a side surface having an acoustical resistance associated therewith, the acoustical resistance substantially greater than an acoustical resistance between either of the ports and its respective microphone chamber.

2. The switch of claim 1, wherein the switch actuator pivotably engages the faceplate of the hearing aid device and the faceplate is adapted to engage the microphone.

3. The switch of claim 1, further including a switch housing having the switch actuator moveably disposed therein, the switch housing adapted to engage the microphone.

4. The switch of claim 3, wherein the switch actuator further includes a detent that engages a detent spring disposed adjacent thereto within the switch housing.

5. The switch of claim 1, wherein the switch actuator further includes a detent that is adapted to engage a detent spring disposed adjacent thereto within the hearing aid, the detent causing the spring to deflect as the switch actuator is moved from the first position to the second position.

6. The switch of claim 1, further including at least three electrical contacts disposed within the hearing aid and each having a portion juxtaposed to the side surface of the body portion of the switch actuator, wherein the side surface includes a swiping contactor disposed therein and adapted to make selective contact with the portions of the electrical contacts when the switch actuator is moved from the first position to the second position.

7. The switch of claim 3, further including at least three electrical contacts each having a portion disposed within the switch housing and juxtaposed to the side surface of the body portion of the switch actuator, wherein the side surface includes a swiping contactor disposed therein and adapted to make selective contact with the portions of the electrical contacts when the switch actuator is moved from the first position to the second position.

8. The switch of claim 1, wherein the side surface of the body portion has a surface area greater than a surface area of each of the closure surfaces individually, the greater surface area effectively lengthening an acoustical path associated with the side surface of the body portion.

9. An acoustical switch for a directional microphone of a hearing aid device, the hearing aid including a faceplate having a switch aperture defining a side surface, the microphone including a front inlet in communication with a front chamber of the microphone and two rear inlets in communication with a rear chamber of the microphone, the acoustical switch comprising a switch actuator having a body portion and a lever portion, the body portion including a first closure surface and a second closure surface, the switch actuator disposed within the switch aperture of the face plate such that the body portion is disposed adjacent to the inlets of the microphone, the switch actuator pivotably connected to the faceplate to facilitate movement between a first position wherein the first closure surface of the body portion is adapted to cover one of the rear inlets of the microphone, and a second position wherein the second closure surface of the body portion is adapted to cover the other of the rear inlets of the microphone, the body portion further including a side surface extending transverse to the closure surfaces that cooperates with the side surface of the faceplate to define an acoustical path having an associated acoustical resistance that minimizes acoustical leakage signals.

10. The switch of claim 9, wherein the switch actuator further includes a detent that is adapted to engage a detent spring disposed adjacent thereto within the faceplate of the hearing aid, the detent causing the spring to deflect as the switch actuator is moved from the first position to the second position.

11. The switch of claim 9, further including at least three electrical contacts disposed within the hearing aid and each having a portion juxtaposed to the side surface of the body portion of the switch actuator, wherein the side surface includes a swiping contactor disposed therein and adapted to make selective contact with the portions of the electrical contacts when the switch actuator is moved from the first position to the second position.

12. The switch of claim 9, wherein the side surface of the body portion has a surface area greater than a surface area of each of the closure surfaces individually, the greater surface area effectively lengthening an acoustical path associated with the side surface of the body portion.

13. An acoustical switch for a directional microphone of a hearing aid device, the microphone including a front inlet in communication with a front chamber of the microphone and two rear inlets in communication with a rear chamber of the microphone, the acoustical switch comprising:

a switch housing having an interior surface; and a switch actuator moveably disposed within the switch housing between a first switch position and a second switch position, the switch actuator having a body portion and a lever portion, the body portion including a first closure surface and a second closure surface;

the switch actuator adapted to be disposed adjacent to the inlets of the microphone when the switch is installed into the hearing aid such that when the switch actuator is in the first position, the first closure surface of the body portion covers one of the rear inlets of the microphone, and when the switch actuator is in the second position, the second closure surface of the body portion covers the other of the rear inlets of the microphone;

the body portion further including a side surface extending transverse to the closure surfaces and juxtaposed to the interior surface of the housing, the side surface cooperating with the interior surface of the housing to establish an acoustical resistance therebetween that minimizes acoustical leakage signals.

14. The switch of claim 13, wherein the switch actuator further includes a detent that engages a detent spring disposed adjacent thereto within the switch housing.

15. The switch of claim 13, further including at least three electrical contacts each having a portion disposed within the switch housing and juxtaposed to the side surface of the body portion of the switch actuator, wherein the side surface includes a swiping contactor disposed therein and adapted to make selective contact with the portions of the electrical contacts when the switch actuator is moved from the first position to the second position.

16. The switch of claim 13, further including at least four electrical contacts each having a portion disposed within the switch housing and juxtaposed to the side surface of the body portion of the switch actuator, wherein the side surface includes a swiping contactor disposed therein and adapted to make selective contact with the portions of the electrical contacts when the switch actuator is moved from the first position to the second position, the contacts together defining three electrical positions of the switch.

17. The switch of claim 13, wherein the side surface of the body portion has a surface area greater than a surface area of each of the closure surfaces individually, the greater surface area effectively lengthening an acoustical path associated with the side surface of the body portion and the interior surface of the housing.

18. The switch of claim 13, wherein the body portion of the switch actuator has a shape of a sector of a circle and the lever extends from a curved surface defined by the sector shape.

19. The switch of claim 13, wherein the switch housing includes an opening adapted to receive the microphone.

20. The switch of claim 13, wherein the housing comprises a first portion and a second portion that enclose the body portion of the switch actuator when connected together.

* * * * *

UNITED STATES PATENT AND TRADEMARK OFFICE

CERTIFICATE OF CORRECTION

PATENT NO. : 7,136,497 B2
APPLICATION NO. : 10/417577
DATED : November 14, 2006
INVENTOR(S) : John McSwiggen et al.

It is certified that error appears in the above-identified patent and that said Letters Patent is hereby corrected as shown below:

On the Title Page:

Item (73), "LLC." should be -- LLC --.

Item (57), line 15, "actuator s" should be -- actuator is --.

Signed and Sealed this

Thirteenth Day of March, 2007

JON W. DUDAS
*Director of the United States Patent and Trademark Office*